United States Patent [19]

Bonassi

[11] Patent Number: 4,523,744

[45] Date of Patent: Jun. 18, 1985

[54] WINCH FOR SHEET WINDING ON SEACRAFTS

[76] Inventor: Luciano Bonassi, Via Filippo Reina 33, 21047 Saronno, Italy

[21] Appl. No.: 427,269

[22] Filed: Sep. 29, 1982

[30] Foreign Application Priority Data

Oct. 15, 1981 [IT] Italy ..... 23224/81[U]

[51] Int. Cl.[3] ..... B66D 1/74

[52] U.S. Cl. ..... 254/371

[58] Field of Search ..... 254/371, 344, 390

[56] References Cited

U.S. PATENT DOCUMENTS

| | | | |
|---|---|---|---|
| 900,737 | 10/1908 | Jackson | 254/390 |
| 3,968,953 | 7/1976 | Guangorena | 254/371 |
| 4,369,952 | 1/1983 | Kurling | 254/371 |

*Primary Examiner*—Billy S. Taylor

*Attorney, Agent, or Firm*—Michael J. Striker

[57] ABSTRACT

A winch for sheet winding on seacrafts, including a fixed mount, a drum for sheet winding, a rotatable shaft for operationally rotating the drum, a pair of blocking rings operationally connected to the drum and forming between the rings a groove having an axis extending in a predetermined direction and arranged to grasp and drag the sheet into rotation when the sheet is under stress, and a roller for passing thereover the sheet coming from the drum and directed to the groove or vice versa and having an axis which extends in a direction substantially corresponding to the direction of extension of the groove and is slanted to the axis of the groove at a small angle, so that when the sheet passes from the groove to the roller the sheet reaches the roller in a direction almost perpendicular to the axis of the roller.

4 Claims, 3 Drawing Figures

WINCH FOR SHEET WINDING ON SEACRAFTS

The present invention refers to a winch, intended particularly for use on board of sea-crafts, provided both with means fitted to guide the sheet from a winding drum to a sheet pulley or, more generally, to a groove fit to grasp the sheet and drag it into rotation, and with means fitted to ease away the same sheet from said groove. Winches used on boats are devices fitted to put under stress the sheets coming from the sails with a certain vertical slant and made horizontal by interposing a sheet leader.

Notoriously, boat winches used to put under stress sail sheets do present a fixed mounting provided with devices which permit to secure it on the application point; a sheet winding drum, operated by a group of gears by means of a driving shaft put into rotation—for instance—by a manouvering crank, which can be inserted manually in the winch itself, and possibly by a couple of blocking rings connected to said drum and creating a groove capable of grasping and dragging into rotation the sheet under stress and finally provided with means fitted to lead the sheet itself.

Said sheet leading devices are generally carried by an annular plate laying over said groove and are composed of a beak jut over which the sheet coming from the drum and directed towards the groove is obliged to pass.

The trouble with these known devices is that the sheet coming from the drum and directed towards said groove is forced to creep over this beak jut with a certain friction, thus transmitting remarkable stresses to the annular support plate and causing, in the long run, the wearing both of the sheet itself and of the leading beak.

The present invention is intended to obviate this and other disadvantages encountered in the existing winches, by providing unexpensive and highly reliable means by which considerably ease the slipping of the sheet from the drum to the groove with no danger of wearing of the parts in contact, while at the same time making it easier to pay out the sheet itself. These guiding devices, which will be illustrated in the following description, can be assembled on whatever type of winch, with appropriate modifications if necessary. To achieve these goals, the winch of the present invention is provided with a smaller roller over which is led to pass the sheet coming from the drum and directed to the groove. This roller is transversally slanted so that the sheet reaches it in a direction almost at right angles with its axis. The roller is revolving on a plug-pin whose nose is constrained into a hole machined inside a lateral projection part of an annular plate placed over the groove. Said projection presents a plane surface at right angles with the pin axis, while the head of said pin, which operates also as a shoulder for the roller, is layed down into the hole existing in a plane jut, of a second annular plate paced below said groove. This last jut is slanted in such a way to result parallel to the plane surface of the first jut.

The winch described in the present invention is illustrated, only as an example and therefore not limited in its embodiment, in the enclosed drawings, where:

Figure 1:
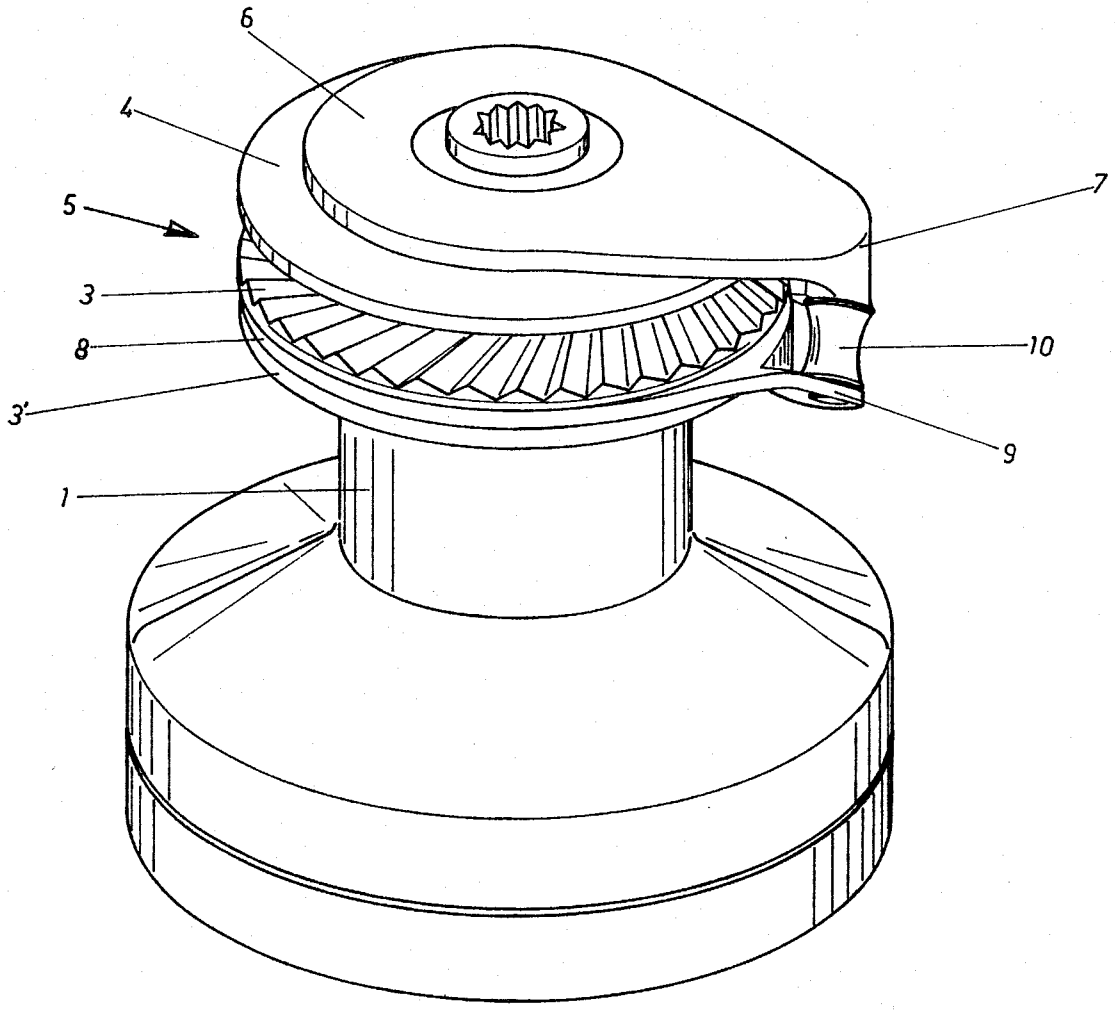
FIG. 1 is an axonometric view of the winch according to the present invention.

With reference to said figures it may be noted that an ordinary winch is composed of a winding drum 1 where sheet 2 winds itself.

Said drum is operated by a group of gears, by means of a shaft put into rotation by an operating crank. These gears are to be intended as well known and therefore are not shown in the enclosed drawings.

Above drum 1 is positioned a couple of ring-shaped blocking elements 3 and 4, operationally connected to drum 1, which form between themselves a groove fitted to grasp and drag into rotation sheet 2 when the drum is rotated.

On the upper part of said annular element 4 is placed a further annular plate 6, which is fastened to the mount of the device and therefore is fixed with respect to drum 1. Said plate has a diameter smaller than the one of elements 3 and 4 and is becoming thinner upward in order to provide a lateral jut 7 which projects downward beyond the edge of element 4 and terminates with a plane surface 7', slanted by a certain angle with respect to plate 6 plane.

It must be noted that below annular element 3, at a certain distance from the element itself, is placed another ring 3' locked to 3, in such a way as to create between rings 3 and 3' a groove where is housed an annular plate 8 which is provided with a plane jut 9 slanted downward with respect to the plane of the plate itself, so that it is parallel to the plane surface 7' of jut 7.

Between said juts 7 and 9 of the respective plates 6 and 8 is positioned a smaller roller 10, whose axis is perpendicular to said juts and therefore slanced, with respect to the vertical, of an angle which is equal to the one that juts 7 and 9 have with respect to the horizontal plane. The inclination is such that the sheet coming from the drum reaches roller 10 from a direction perpendicular to its axis, in order to avoid transversal strains.

Figure 2:
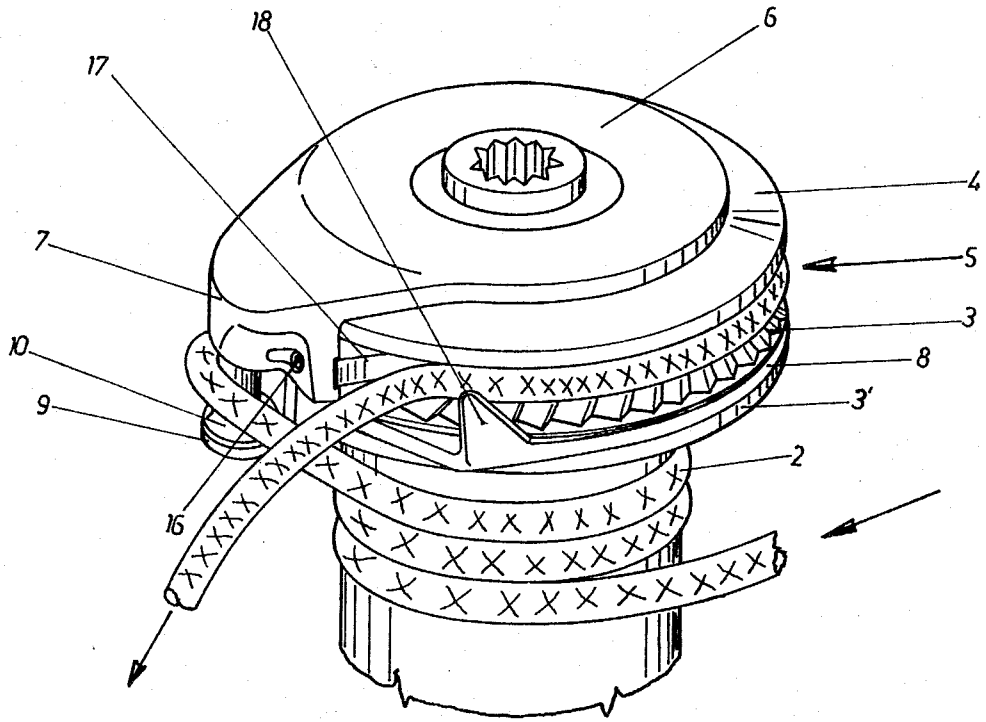
FIG. 2 shows, again axonometrically but according to a different angle, the winch of FIG. 1, putting into evidence the means adopted for leading the sheet.
Figure 3:
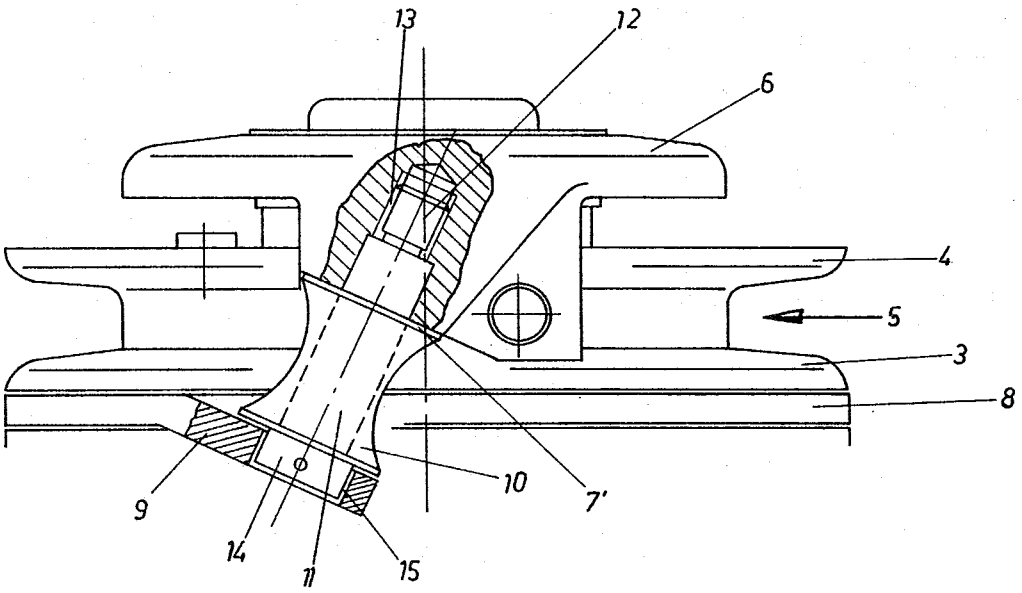
FIG. 3 is a partial view in elevation, and partially in section, of the winch of FIG. 1.

Roller 10 is free to rotate around a plug-spin 11 (see FIG. 3), whose point 12 is fastened in a hole 13 machined in jut 7 and whose head 14 is layed in a hole 15 machined in jut 9. Constrained by means of a bolt 16 (see FIG. 2) to jut 7, there is a geather-key arm 17, which penetrates inside groove 5 in order to extract from said groove the sheet 2 and lead it radially out of the groove, with the aid of a jut 18 of ring 8 turned upward when drum 1 is being put into rotation.

Naturally, the present invention can be embodied also in forms different from the one described in the present paper, still remaining within the range of the invention itself.

I claim:

1. A winch for sheet winding on seacrafts, comprising, a fixed mount;

a drum for sheet winding;

means including a rotatable shaft for operationally rotating said drum;

a pair of blocking rings operationally connected to said drum, said pair of blocking rings forming therebetween a groove having an axis extending in a predetermined plane and arranged to grasp and grab the sheet into rotation when the sheet is under stress;

a roller for passing thereover the sheet coming from said drum and directed to said groove or vice versa, said roller having an axis which extends in a plane substantially corresponding to said plane of said axis of said groove and is slanted to said plane of said axis of said groove at a small angle, so that when the sheet passes from said groove to said roller the sheet reaches the roller in direction almost perpendicular to said plane of said axis of said roller;

and means for supporting said roller including an upper and a lower annular plate each respectively containing a jutting portion having a hole, said upper annular plate being disposed in an upper part of said groove and said lower annular plate being disposed below said groove, said supporting means further including a plug-pin having a pin axis and a nose retained in said hole of said jutting portion of said upper annular plate, said upper jutting portion having a plane surface disposed perpendicular to said pin axis of said plug-pin, said roller being turnable around said plug-pin.

2. The winch as defined in claim 1; further comprising a handle crank axially insertable on said shaft for operating said shaft.

3. The winch as defined in claim 1, wherein said jutting portion of said lower annular plate is offset from said jutting portion of said upper annular plate and is slanted so as to be parallel to said plane surface of said jutting portion of said upper annular plate.

4. A winch for sheet winding on seacrafts, comprising:

a fixed mount;

a drum for sheet winding;

means including a rotatable shaft for operationally rotating said drum;

a pair of blocking rings operationally connected to said drum, said pair of blocking rings forming therebetween a groove having an axis extending in a predetermined plane and arranged to grasp and drag the sheet into rotation when the sheet is under stress;

a roller for passing thereover the sheet coming from said drum and directed to said groove or vice versa, said roller having an axis which extends in a plane substantially corresponding to said plane of said axis of said groove and is slanted to said plane of said axis of said groove at a small angle, so that when the sheet passes from said groove to said roller the sheet reaches the roller in a direction almost perpendicular to said plane of said axis of said roller;

and means for supporting said roller including an upper and a lower annular plate each respectively containing a jutting portion having a hole, said upper annular plate being disposed in an upper part of said groove and said lower annular plate being disposed below said groove, said supporting means further including a plug-pin having a nose retained in said hole of said jutting portion of said upper annular plate and a head disposed in said hole of said jutting portion of said lower annular plate, said roller being turnable around said plug-pin, said head being a shoulder for said roller.

* * * * *